US010240262B2

(12) United States Patent
Braun et al.

(10) Patent No.: US 10,240,262 B2
(45) Date of Patent: Mar. 26, 2019

(54) METHOD FOR CLEANING A TEXTILE MACHINE

(71) Applicant: Rieter Ingolstadt GmbH, Ingolstadt (DE)

(72) Inventors: Ludwig Braun, Ingolstadt (DE); Adalbert Stephan, Beilngries/Paulushofen (DE); Guenther Reinhardt, Ingolstadt (DE)

(73) Assignee: Rieter Ingolstadt GmbH, Ingolstadt (DE)

( * ) Notice: Subject to any disclaimer, the term of this patent is extended or adjusted under 35 U.S.C. 154(b) by 59 days.

(21) Appl. No.: 15/423,814

(22) Filed: Feb. 3, 2017

(65) Prior Publication Data

US 2017/0226665 A1 Aug. 10, 2017

(30) Foreign Application Priority Data

Feb. 4, 2016 (DE) ..... 10 2016 102 010

(51) Int. Cl.

| | |
|---|---|
| ***D01H 5/66*** | (2006.01) |
| ***D01H 11/00*** | (2006.01) |
| ***B08B 5/04*** | (2006.01) |
| ***B08B 13/00*** | (2006.01) |
| ***D01G 19/22*** | (2006.01) |

(52) U.S. Cl.

CPC ..... *D01H 5/66* (2013.01); *B08B 5/04* (2013.01); *B08B 13/00* (2013.01); *D01G 19/22* (2013.01); *D01H 11/006* (2013.01)

(58) Field of Classification Search

USPC ..... 134/15, 18, 32, 22.1, 42; 57/300, 301, 57/264, 265, 263, 262

See application file for complete search history.

(56) References Cited

U.S. PATENT DOCUMENTS 3,672,143 A * 6/1972 Whitney ..... D01H 13/145 57/264
4,192,129 A 3/1980 Stahlecker
(Continued)

FOREIGN PATENT DOCUMENTS

DE 33 08 248 A1 9/1984
DE 41 07 403 A1 9/1992
(Continued)

OTHER PUBLICATIONS

EP Search Report, dated Jun. 30, 2017.
German Search Report, dated Nov. 18, 2016.

*Primary Examiner* — Eric W Golightly
*Assistant Examiner* — Arlyn I Rivera-Cordero
(74) *Attorney, Agent, or Firm* — Dority & Manning, P.A.

(57) ABSTRACT

A method for cleaning a textile machine having a plurality of work stations includes issuing a cleaning request for a first one of the work stations. In response to the cleaning request, the first work station is approached and cleaned by a mobile cleaning device that travels alongside of the textile machine. The cleaning requests are issued for the work stations depending on specifically identified contamination-generating events that have occurred at or near the respective work station since a last cleaning process at the work station. A textile machine configured in accordance with the method is also provided.

15 Claims, 1 Drawing Sheet

(56) References Cited

U.S. PATENT DOCUMENTS

| | | | | |
|---|---|---|---|---|
| 4,222,224 | A * | 9/1980 | Raasch | D01H 13/14 57/263 |
| 4,514,973 | A * | 5/1985 | Stahlecker | D01H 4/26 57/301 |
| 4,653,262 | A | 3/1987 | Engeli | |
| RE32,670 | E | 5/1988 | Stahlecker | |
| 4,864,679 | A | 9/1989 | Briner | |
| 5,182,903 | A | 2/1993 | Stahlecker | |
| 5,732,543 | A | 3/1998 | Bungter et al. | |
| 7,010,383 | B2 * | 3/2006 | Zipperer | B65H 54/26 700/139 |
| 2003/0056486 | A1 * | 3/2003 | Bahlmann | B65H 54/26 57/264 |

FOREIGN PATENT DOCUMENTS

| | | | |
|---|---|---|---|
| DE | 195 29 654 | A1 | 2/1997 |
| DE | 101 48 330 | A1 | 2/2003 |
| DE | 102 51 935 | A1 | 5/2004 |
| EP | 0 259 622 | A1 | 3/1988 |
| EP | 2 982 784 | A2 | 2/2016 |

* cited by examiner

METHOD FOR CLEANING A TEXTILE MACHINE

FIELD OF THE INVENTION

The present invention relates to a method for cleaning a textile machine consisting of a multiple number of identical work stations, whereas a cleaning request is issued for a work station and the work station to be cleaned is approached and cleaned by a mobile cleaning device. The invention also relates to a textile machine with a multiple number of identical work stations, a mobile cleaning device and a control device.

BACKGROUND

The cleaning of work stations of textile machines by mobile cleaning devices is well-known. There are various methods according to the aspects of which the cleaning device approaches the individual work stations. For example, EP 0 259 622 B1 describes a method with which the cleaning device moves, beginning at a first work station, from work station to work station, up to the last work station. Once such a work cycle has been completed, the cleaning device begins the next working cycle, either immediately or after a certain waiting time from the front. However, this method does not take into account the fact that the individual work stations become contaminated at different speeds. This may be due to, for example, varying submission materials, a varying number of thread breaks that previously occurred or even only the varying spatial positions of the work stations on the textile machine. Accordingly, however, cleaning at different times is necessary for the individual work stations.

SUMMARY OF THE INVENTION

Thus, it is a task of the present invention to provide a method for cleaning a textile machine consisting of a multiple number of identical work stations, which takes into account the varying degrees of contamination of the individual work stations. Additional objects and advantages of the invention will be set forth in part in the following description, or may be obvious from the description, or may be learned through practice of the invention.

The tasks are achieved by a method for cleaning a textile machine and a textile machine with the characteristics as set forth herein.

The invention relates to a method for cleaning a textile machine consisting of a multiple number of identical work stations. This may be, for example, a rotor spinning machine, an air spinning machine, a ring spinning machine or even a winding machine or another textile machine, which features a series of identical work stations and is cleaned by a mobile cleaning device. In the case of a spinning machine, a work station is understood to mean a unit that spins a sliver coming from a can into a thread, and winds the thread onto a bobbin.

With the method, a cleaning request is issued for a work station. This can be effected both by the work station itself and by a control device of the textile machine. If a cleaning request has been issued, the work station is approached and cleaned by a mobile cleaning device.

In accordance with the invention, the cleaning request is issued depending on the events that have occurred at the respective work stations since the last cleaning process. Such events are an indication of the contamination of the work station since the last cleaning process. Thus, the method takes into account the varying degrees of contamination of the individual work stations.

Advantageously, the events include predetermined disruptions, predetermined combinations of measured values, preferably in the form of measured values of quality, piecing processes, the changing of bobbins and/or changing of cans. The disruptions include, for example, thread breaks or clearer cuts. In doing so, all or even a few predetermined disruptions can be regarded as events. Measured values, preferably measured values of quality, include, for example, the thickness or color of the thread. Certain combinations of such measured values herein indicate a cleaning request at a work station, and can consequently also be regarded as events. Piecing processes are herein understood to mean both the joining of two loose thread ends after a thread break or a clearer cut, along with the setting of a thread at an empty or partially wound bobbin. The changing of bobbins and cans can directly indicate how much yarn or textile material has been processed. Since, for each processed quantity of yarn or textile material, a certain contamination accumulates, and changes of bobbins and cans are good indicators of the contamination that has accumulated. Moreover, dirt accumulates or dirt is stirred up upon each piecing process. Therefore, this is also a good indicator of the contamination of the work station. However, this list of events is not exclusive: depending on the textile machine, other events can also be taken into account; for example, certain maintenance processes by means of a maintenance device or the exchange of wearing parts.

It is advantageous if, in the case of a cleaning run requested by a work station, the work stations located along the path of the cleaning device are also cleaned depending on the events that have occurred at the respective work stations since the last cleaning process. In this case, such dependency is selected such that the work stations located along the path of the cleaning device are already cleaned even if they themselves have not yet issued a cleaning request, but if, on the basis of the events that have already occurred, it is foreseeable that they will soon issue a cleaning request. This avoids unnecessarily frequent or long runs of the cleaning device, which increases the efficiency of the cleaning device.

It is advantageous if the dependency is the exceeding of a (preferably weighted) number of events. For example, a change of cans indicates that a relatively large quantity of yarn has been processed and, accordingly, a high degree of contamination has been brought about. Thus, the weighting factor for changing the cans is relatively high. On the other hand, a single piecing process causes only a relatively low degree of contamination, such that the weighting factor for a piecing process is selected to be relatively small. If a certain threshold value of weighted events is then exceeded, this indicates that a certain degree of contamination has been reached. Thereupon, a cleaning request is issued.

As described above, for work stations that are located along the path of the cleaning device, a somewhat smaller threshold is selected in order to determine whether or not they are cleaned during the cleaning run. Thus, such work stations can also be cleaned if they have not quite reached the threshold value that would lead to a cleaning request.

It is also advantageous if the events are weighted according to their distance to the respective work station. Thus, most of the contamination is typically caused by the spinning operation at the respective work station itself. However, the spinning operation at the adjacent work stations also causes a certain (but with an increasing distance, less)

contamination of a work station. Thus, the greater the distance of the work station at which an event occurs to the observed work station, the smaller the weighting factor selected. Typically, it is sufficient to consider the events of a few adjacent work stations.

It is also advantageous if the dependency is a predetermined sequence of events. If, for example, a certain number of piecing processes are exceeded between two bobbin changes, it is to be assumed that an error exists. This error could come from a work station that is too contaminated, but could have other causes. Thus, the issuing of a cleaning request after a certain number of piecing processes in succession thus serves to remedy possible contamination as a cause of error. If, after the cleaning process has been carried out, a large number of piecing processes are still carried out successively, the cause of the error is probably different. In this case, a maintenance device must service the work station, or operating personnel must investigate the cause of the accumulation of piecing processes.

If the last cleaning of a work station trails behind for a long period of time, such work station can be contaminated in particular by dust or fibers contained in the ambient air. Thus, if a predetermined period of time has elapsed since the last cleaning of the work station, it is advantageous if a cleaning request is issued for such work station in order to ensure that the corresponding work stations are not excessively contaminated at any time.

Advantageously, a cleaning request is issued only for running work stations. If a work station does not run for a long period of time, it could occur through events at neighboring work stations that a cleaning request is nevertheless issued.

However, it is only worthwhile to issue a cleaning request if the work station will soon run again. Since this is not foreseen in the case of work stations that do not run for a long period of time, it is more efficient if work stations that are not running do not issue any cleaning requests.

If, on the other hand, a work station that is not running is located along the path of a cleaning device, it is favorable if it is also cleaned depending on the events that have occurred since the last cleaning process, such that excessive contamination of such work station is avoided.

It is advantageous if the mobile cleaning device is operated as a separate cleaning unit. The cleaning device can then be moved, largely independently of other maintenance devices, along the textile machine and thus to the individual work stations, and does not have to coordinate the processing of the cleaning requests with other maintenance requests.

However, it can also be advantageous if the cleaning device is operated as a part of a larger movable maintenance device. Thus, the cleaning device does not require a separate drive, and it is not necessary to pay attention to possible collisions between the cleaning device and the larger maintenance device (whereas the maintenance device is formed, for example, as a service robot that carries out the aforementioned piecing processes).

In the case of textile machines with a large number of work stations, more than one cleaning device is necessary in order to service all cleaning requests. It is then advantageous if an overlapping area is provided, which can be cleaned by at least two cleaning devices. Through a skillful distribution of the cleaning requests arising in the overlapping area, the efficiency of the cleaning devices can be increased. Preferably, a maximum of one cleaning device at a given point in time remains within the overlapping area. This is a simple but effective method to avoid collisions between the cleaning devices.

If the cleaning request for a work station is issued in the overlapping area, it is advantageous if the cleaning process is carried out by that cleaning device that features a lower workload. Thus, an adjustment to the workloads is achieved and the efficiency of the cleaning devices is increased.

However, if the cleaning request for a work station is issued in the overlapping area, it may also be advantageous if the cleaning process is carried out by that cleaning device that is closer to the work station for which the cleaning request was issued. With this strategy, unnecessarily long travel distances of the cleaning devices are avoided, and the cleaning can be carried out more promptly.

Furthermore, a textile machine with a multiple number of identical work stations is proposed. The textile machine also features a mobile cleaning device and a control device. At this, the control device is formed to issue cleaning requests for work stations, and the cleaning device is formed to approach and clean a work station for which a cleaning request was issued.

In accordance with the invention, the control device is formed in such a manner that it cleans the textile machine in accordance with the previously described aspects. The control device thus issues cleaning requests depending on events that have occurred at the respective work stations since the last cleaning process. Such events are an indication of the contamination of the work station since the last cleaning process. The control device is thus formed to take into account the varying degrees of contamination of the work stations when issuing the cleaning requests.

It is herein advantageous if the mobile cleaning device is formed as a separate cleaning unit. The cleaning device can then be moved along the textile machine largely independently of other maintenance devices, and does not have to coordinate the processing of the cleaning requests with other maintenance requests.

However, it may also be advantageous if the cleaning device is formed as part of a larger mobile maintenance device. Thus, a separate drive for the cleaning device is spared, and it is not necessary to pay attention to possible collisions between the cleaning device and the larger maintenance device.

BRIEF DESCRIPTION OF THE DRAWINGS

Further advantages of the invention are described in the following embodiments. The following is shown.

DETAILED DESCRIPTION

Figure 1:
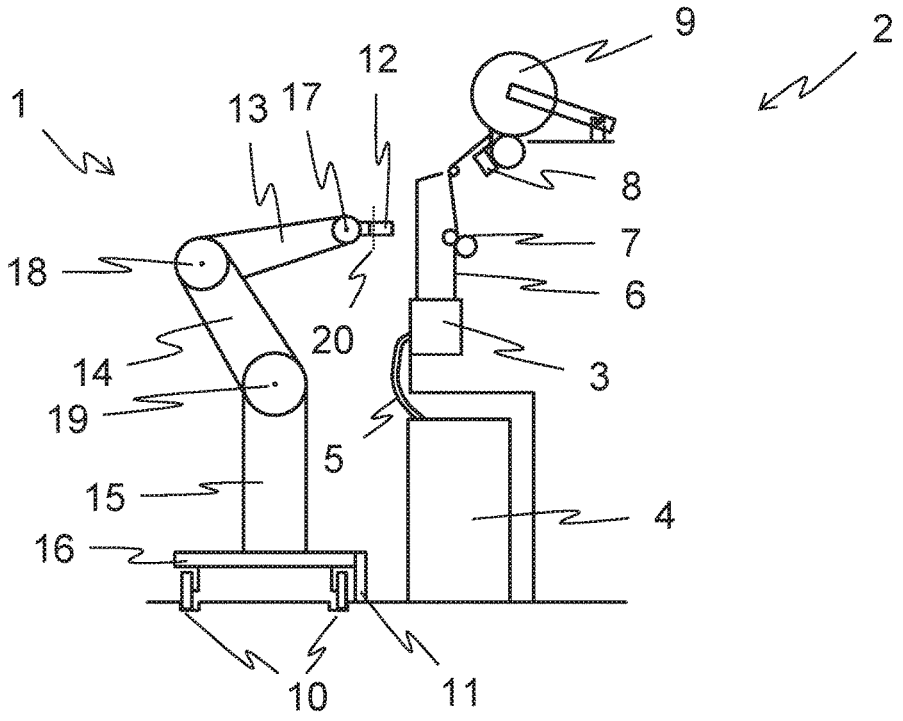
FIG. 1 is a side view of a cleaning device in front of a work station.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

FIG. 1 shows a mobile cleaning device 1 in front of a work station 2 of a textile machine. In this case, the textile machine is a rotor spinning machine. The method in accordance with the invention is, however, applicable in principle to other spinning machines or, in general, to any textile machine with a multiple number of identical work stations 2 and a mobile cleaning device 1.

The work station 2 features a spinning unit 3, which spins a sliver 5 coming from a can 4 into a thread 6. The thread 6 is then taken up by a pair of draw-off rollers 7 and wound on a bobbin 9 by means of a traverse element 8.

Events such as a change of the can 4, a change of the bobbin 9 or a setting of the thread 6 are transmitted from the work station 2 to a control device of the textile machine. If a predetermined threshold value of weighted events for the work station 2 is reached or exceeded, the control device requests the cleaning of the work station 2 by the cleaning device 1.

The cleaning device 1 then travels along rails 10 to the work station 2, where it positions itself precisely by means of a positioning element 11 assigned to the work station. In this embodiment, the cleaning itself is carried out by a suction nozzle 12. The suction nozzle 12 is herein connected to the chassis 16 of the cleaning device 1 by means of several arms 13, 14, 15. The suction nozzle 12 and the arms 13, 14 can be swiveled around horizontal axes 17, 18, 19, and the suction nozzle can also be swiveled around the vertical axis 20. Thus, the suction nozzle 12 can be moved to the objects of the work station 2 to be vacuumed.

However, the method described here is not limited to cleaning by sucking away contamination; rather, other cleaning methods, for example with compressed air or with mechanical cleaning elements, are also conceivable.

Figure 2:
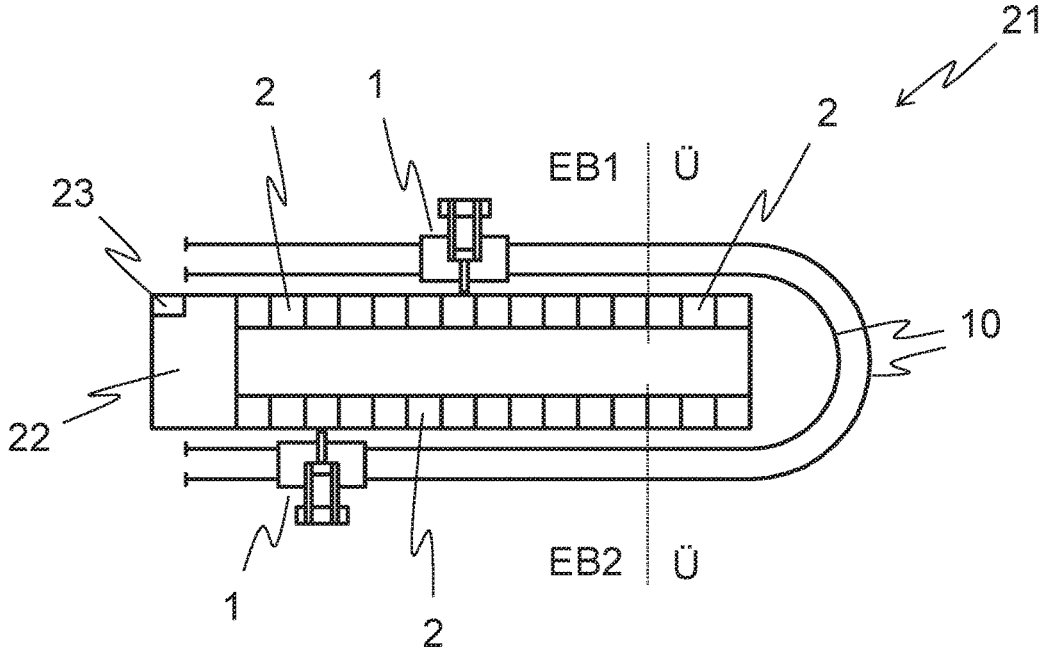
FIG. 2 is a top view of a textile machine with a multiple number of work stations and two cleaning devices.

FIG. 2 shows a top view of a textile machine 21 with a multiple number of work stations 2 and two cleaning devices 1. The cleaning devices can be moved along the rails 10.

The work stations 2 are assigned to one of three areas: an exclusive area EB1 which is located on a machine side of the textile machine 21, an exclusive area EB2, which is located on the other machine side, and an overlapping area Ü.

The work stations 2 send information regarding events such as the changing of cans, the changing of bobbins and/or piecing processes to a control device 23 arranged at the machine end 22. Such events are provided with a weighting factor by the control device 23. The greater the contamination associated with the event, the greater is the weighting factor. For each work station 2, a sum of the weighted events is formed. In doing so, events that have arisen at adjacent work stations 2 are also counted, but such events are provided with a further weighting factor, which is the smaller, as the distance from the event to the work station 2 is larger.

If a threshold value for weighted events for a work station 2 is exceeded, a cleaning request is issued for such work station 2. If the work station 2 is located in the exclusive area EB1, which is assigned to the upper cleaning device 1 in FIG. 2, the cleaning device 1 travels to the work station 2 for which the cleaning request was issued. The lower cleaning device 1 in FIG. 2 is also responsible for the work stations 2 in the exclusive area EB2. However, if the cleaning request is issued for a work station in the overlapping area U, the cleaning process is carried out by that cleaning device 1 that features the lower workload.

Along the path of the cleaning device 1 to the work station 2, for which the cleaning request was issued, all work stations 2, whose weighted event sum exceeds a certain threshold value, are also cleaned.

After the cleaning has been completed, the weighted event sum for the cleaned work station 2 is set to zero and the counting starts from the beginning.

This invention is not limited to the illustrated and described embodiments. Variations within the scope of the claims, just as the combination of characteristics, are possible, even if they are illustrated and described in different embodiments.

LIST OF REFERENCE SKINS

1 Cleaning device
2 Workstation
3 Spinning unit
4 Can
5 Sliver
6 Thread
7 Pair of draw-off rollers
8 Traverse element
9 Bobbin
10 Rails
11 Positioning element
12 Suction nozzle
13 Arm
14 Arm
15 Arm
16 Chassis
17 Horizontal axis
18 Horizontal axis
19 Horizontal axis
20 Vertical axis
21 Textile machine
22 Machine end
23 Control device
EB1 Exclusive area
EB2 Exclusive area
Ü Overlapping area

The invention claimed is:

1. A method for cleaning a textile machine having a plurality of work stations, the method comprising:

issuing a cleaning request for a first one of the work stations;

in response to the cleaning request, the first work station is approached and cleaned by a mobile cleaning device that travels alongside of the textile machine;

wherein cleaning requests are issued for the work stations depending on specifically identified contamination-generating events that have occurred at or near the respective work stations since a last cleaning process at the work stations; and wherein in a cleaning run by the mobile cleaning device to the first work station, a non-requesting second work station located along the cleaning run is also cleaned when events that have occurred at the second work station since the last cleaning process from the second work station indicate that a cleaning process request from the second work station is forthcoming.

2. The method according to claim 1, wherein the events include one or more of the following: predetermined disruptions, predetermined combinations of measured values of quality, piecing processes, changing of bobbins; and changing of cans.

3. The method according to claim 1, wherein the dependency on the events is based on exceeding a specific number of the events at the work stations.

4. The method according to claim 1, wherein the dependency on the events is based on a predetermined sequence of the events.

5. The method according to claim 1, wherein the dependency on the events is further based on a predetermined period of time elapsing since the last cleaning process at the work stations.

6. The method according to claim 1, wherein the cleaning request is issued only for running ones of the work stations.

7. The method according to claim 1, wherein the mobile cleaning device is separate from a maintenance device that also runs along the textile machine.

8. The method according to claim 1, wherein the events are given different weighted values according to degree of potential contamination the events may produce at the work stations, the dependency on the events based on exceeding a defined sum of the weighted values at the work stations.

9. The method according to claim 8, wherein, for a particular work station, the events are weighted according to distance between where the events occurred and the particular work station.

10. The method according to claim 1, wherein multiple ones of the mobile cleaning devices are assigned to different respective sections of the textile machine, wherein an overlapping area of the textile machine is defined between two of the sections and work stations within the overlapping area can be cleaned by the mobile cleaning device assigned to each section adjacent the overlapping area.

11. The method according to claim 10, wherein a cleaning request for one of the work stations in the overlapping area is carried out by the mobile cleaning device from one of the adjacent sections having a lesser workload.

12. The method according to claim 10, wherein a cleaning request for one of the work stations in the overlapping area is carried out by the mobile cleaning device from one of the adjacent sections that is closer to the work station for which the cleaning request was issued.

13. A textile machine, comprising:

a plurality of work stations;

a mobile cleaning device configured to travel along the textile machine work to perform cleaning processes at the work stations;

a control device in communication with the work stations and the mobile cleaning device;

the control device configured to issue cleaning requests for the work stations, wherein the mobile cleaning device travels to a work station for which a cleaning request was issued and performs a cleaning process;

wherein the cleaning requests are issued by the control device for the work stations depending on specifically identified contamination-generating events that have occurred at or near the respective work station since a last cleaning process at the work station; and wherein the control device is further configured to issue a cleaning request to a second work station located along a cleaning run by the mobile cleaning device to a first work station when events that have occurred at the second work station since the last cleaning process from the second work station indicate that a cleaning process request from the second work station is forthcoming.

14. The textile machine according to claim 13, wherein the mobile cleaning device is separate from a maintenance device that also runs along the textile machine.

15. The textile machine according to claim 13, wherein the mobile cleaning device is a component of a maintenance device that runs along the textile machine.

* * * * *